US009696673B2

(12) United States Patent
Omura et al.

(10) Patent No.: US 9,696,673 B2
(45) Date of Patent: Jul. 4, 2017

(54) IMAGE FORMING APPARATUS AND IMAGE FORMING METHOD

(71) Applicant: CANON KABUSHIKI KAISHA, Tokyo (JP)

(72) Inventors: Naoka Omura, Matsudo (JP); Kuniyasu Kimura, Toride (JP); Takuya Hayakawa, Koshigaya (JP); Kiyoharu Kakomura, Nagareyama (JP); Seita Inoue, Kashiwa (JP); Yuya Ohta, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/711,573

(22) Filed: May 13, 2015

(65) Prior Publication Data

US 2015/0338809 A1 Nov. 26, 2015

(30) Foreign Application Priority Data

May 21, 2014 (JP) ..... 2014-105571

(51) Int. Cl.
*G03G 15/00* (2006.01)
*G03G 15/01* (2006.01)
*G03G 15/043* (2006.01)

(52) U.S. Cl.
CPC ..... *G03G 15/5058* (2013.01); *G03G 15/0131* (2013.01); *G03G 15/043* (2013.01);
(Continued)

(58) Field of Classification Search
CPC ..... G03G 15/043; G03G 15/5054; G03G 15/5058; G03G 15/6558–15/6564; G03G 2215/0158; G03G 2215/0161
See application file for complete search history.

(56) References Cited

U.S. PATENT DOCUMENTS 6,002,413 A * 12/1999 Nishizawa ..... B41J 2/471 347/116
6,335,747 B1 * 1/2002 Munakata ..... G03G 15/0194 347/116

(Continued)

OTHER PUBLICATIONS

U.S. Appl. No. 14/670,694, filed Mar. 27, 2015; Inventors: Yuya Ohta, Kuniyasu Kimura, Takuya Hayakawa, Kiyoharu Kakomura, Seita Inoue, Naoka Omura.

*Primary Examiner* — David M Gray
*Assistant Examiner* — Carla Therrien
(74) *Attorney, Agent, or Firm* — Fitzpatrick, Cella, Harper & Scinto

(57) ABSTRACT

The image forming apparatus controls each laser scanner by setting the writing start timing in the sub-scanning direction to form the color registration correction image for correcting color registration at position according to the detection result of the image detection sensor. When forming the image on the sheet, the image forming apparatus sets the writing start timing in the sub-scanning direction according to the detection result of the image detection sensor and the amount of skew of the sheet to control each laser scanner. When forming the density detection toner image for correcting the density, the image forming apparatus sets the writing start timing in the sub-scanning direction to form the image at a position shifted by a pixel unit from the image forming position on the sheet.

16 Claims, 13 Drawing Sheets

(52) U.S. Cl.
CPC ..... *G03G 2215/0129* (2013.01); *G03G 2215/0161* (2013.01); *G03G 2215/0164* (2013.01)

(56) References Cited

U.S. PATENT DOCUMENTS

| | | | | |
|---|---|---|---|---|
| 6,343,202 | B1 * | 1/2002 | Kimura | H04N 1/0405 399/301 |
| 8,368,903 | B2 * | 2/2013 | Takaki | B41J 11/008 271/286 |
| 2004/0239746 | A1 * | 12/2004 | Ozawa | G03G 15/0194 347/116 |
| 2005/0200689 | A1 * | 9/2005 | Shinohara | G03G 15/0194 347/116 |
| 2007/0014595 | A1 * | 1/2007 | Kawagoe | G03G 15/0194 399/301 |
| 2007/0025779 | A1 | 2/2007 | Shinohara | 399/301 |
| 2007/0268357 | A1 * | 11/2007 | Nagata | B41J 29/393 347/243 |
| 2009/0129806 | A1 * | 5/2009 | Sunada | G03G 15/234 399/82 |
| 2011/0150510 | A1 * | 6/2011 | Kondo | G03G 15/043 399/51 |
| 2012/0147115 | A1 * | 6/2012 | Tamaki | G02B 26/122 347/118 |
| 2014/0210926 | A1 * | 7/2014 | Takagi | G03G 15/5054 347/118 |

* cited by examiner

IMAGE WRITING START TIMING
X1

CENTER OF PHOTORECEPTOR
S
IMAGE

CENTER OF PHOTORECEPTOR
S
IMAGE
IMAGE WRITING START TIMING
V1

CENTER OF PHOTORECEPTOR
S
IMAGE
CONVEYING DIRECTION

IMAGE WRITING START TIMING
X1
X3

CENTER OF PHOTORECEPTOR
S
IMAGE

CENTER OF PHOTORECEPTOR
S
IMAGE
IMAGE WRITING START TIMING
V3

CENTER OF PHOTORECEPTOR
S
IMAGE
CONVEYING DIRECTION

IMAGE FORMING APPARATUS AND IMAGE FORMING METHOD

BACKGROUND OF THE INVENTION

Field of the Invention

The present disclosure relates to an image forming apparatus for performing image forming processing by electrophotography, such as a copying machine, a printer, a recording image display device, a facsimile and the like.

Description of the Related Art

The electrophotographic system image forming apparatus forms color images by forming electrostatic images by irradiating laser light to each of the photoreceptors provided for every color; adhering the toner of the corresponding color to each electrostatic image to form the toner images of each color, and sequentially overlapping and transferring the toner images of each color onto the transfer belt. The laser light is reflected by a rotary reflecting mirror such as a polygon mirror and scans the photoreceptor by the rotation of the rotary reflecting mirror. Due to the changes in an ambient environment including temperature or humidity, printing characteristics such as color tones or gradation changes, which cause position registration between the images of each color. Thus, the image forming apparatus forms a test image on the transfer belt, which is the image used to measure density registration or position registration of the image. By detecting the test image formed by a sensor, the image forming apparatus obtains density information representing the density of the image or position registration information representing the position registration amount. The image forming apparatus adjusts the image by correcting the density of the image based on the density information obtained and the position registration of the images of each color (hereinafter referred to as "color registration correction") based on the position registration information obtained. In US2007/0025779(A1), such image adjustment is performed for every time the image formation is performed to a predetermined number of sheets.

The image forming apparatus is designed so as not to convey sheets in a skewed manner, however, it is difficult to completely suppress skewed feeding of the sheet. As a result, the sheet on which the image is formed may be conveyed in a skewed manner. When the image is transferred from the transfer belt to the skewed sheet, the image formed on the sheet is skewed. To solve this, according to the amount of the skew of the sheet, the image is inclined and transferred to the sheet. In this case, by correcting the image data representing the image, the image to be formed is inclined according to the amount of skew of the sheet.

When the skewed feeding of the sheet is corrected by inclining the image, writing start timing of the image in a sub-scanning direction is changed according to the amount of the skew. The processing to correct the image data to incline the image is also performed when correcting the color registration of the images of each color. By performing the color registration correction, the amount of the inclination of the image of each color with respect to the amount of the skew varies. Due to this, the writing start timing in the sub-scanning direction differs.

There may be a case where a timing to form a test image for detecting the color registration (color registration correction test image) does not correspond to a timing to form a test image for detecting density. Regardless of whether the sheet is skewed or not, it is necessary to detect the degree of registration between the colors in a color registration detection control. Thus, the image forming apparatus first controls phase relation of one or more rotating polygon mirrors such to be in a predetermined phase relationship. Then, the image forming apparatus forms the color registration correction test image. The predetermined phase relation is the phase relation having no relationship to data relating to the amount of skew of the sheet. Thus, time to control the phase relation of one or more rotating polygon mirror to be in a predetermined phase relation is provided. By forming the color registration correction test image with the phase relation of one or more rotating polygon mirrors in a predetermined relation and using the detection result and the data relating to the amount of skew, it becomes possible to correct the color registration by a unit of less than one pixel.

On the other hand, in case of the test image for detecting density (density correction test image), detecting the density is only required. Thus, even the image is formed at a position registrated from an ideal position by less than one pixel or a few pixels, the detection result will not change. As mentioned, the phase relation of one or more rotating polygon mirror is controlled when forming the color registration correction test image. If the phase relation of one or more rotating polygon mirror is similarly controlled when forming the density correction test image, time to start forming the next image is delayed. This is because time is taken to control the phase of one or more rotating polygon mirrors. The present disclosure provides the image forming apparatus with less standby time and enhanced productivity.

SUMMARY OF THE INVENTION

According to an aspect of the present disclosure, an image forming apparatus of the present disclosure comprises a first image forming unit having a first photoreceptor and a first laser scanner including a first light source which emits a first laser light and a first rotating polygon mirror which reflects the first laser light such that the first laser light scans the first photoreceptor and, the first image forming unit is configured to form a first toner image, using a first toner, by developing an electrostatic latent image formed on the first photoreceptor by scanning the first laser light; a second image forming unit having a second photoreceptor and a second laser scanner including a second light source which emits a second laser light and a second rotating polygon mirror which reflects the second laser light such that the second laser light scans the second photoreceptor, the second image forming unit is configured to form a second toner image, using a second toner having a color which is different from a color of the first toner, by developing an electrostatic latent image formed on the second photoreceptor by scanning the second laser light; an intermediate transfer member to which the first toner image formed on the first photoreceptor and the second toner image formed on the second photoreceptor are transferred; a transfer unit configured to transfer the first toner image and the second toner image transferred to the intermediate transfer member to a recording medium; a conveyance unit configured to convey the recording medium to the transfer unit; a first optical sensor configured to detect the first toner image and the second toner image transferred to the intermediate transfer member; a second optical sensor arranged at a position different from where the first optical sensor is arranged in a direction which crosses a direction in which the surface of the intermediate transfer member moves and configured to detect the first toner image and the second toner image formed on the intermediate transfer belt; a storing unit configured to store data relating to the amount of skew of the recording medium to be conveyed to the transfer unit by the conveyance unit; and a control unit configured to control the first image forming unit and the second image forming unit. It is noted that the control unit is further configured to: control, based on at least one of the data relating to the amount of skew and a detection result of a color registration detection toner image for detecting relative position relation of the first toner image and the second toner image, toner image forming positions of the first toner image and the second toner image by controlling at least one of a phase relation of the first rotating polygon mirror and the second rotating polygon mirror and an emission timing of the first laser light and an emission timing of the second laser light; cause the first image forming unit and the second image forming unit to form the color registration detection toner image without correcting the first toner image forming position and the second toner image forming position using the data relating to the amount of skew; control, based on the data relating to the amount of skew and the detection result of the color registration detection toner image detected by the first optical sensor and the second optical sensor, the emission timing of the first laser light and the emission timing of the second laser light to correct the rotation phase relation of the first rotating polygon mirror and the second rotating polygon mirror, and to correct the image forming position of the recording medium in a conveying direction of the recording medium such that the first toner image and the second toner image to be transferred to the recording medium is formed on the intermediate transfer member corresponding to the amount of skew of the recording medium to be conveyed to the transfer unit; and color registration between the first toner image and the second toner image is suppressed, and cause the first image forming unit and the second image forming unit to form density detection toner image for detecting density of the first toner image and the second toner image formed by the first image forming unit and the second image forming unit by controlling the emission timing of the first laser light and the emission timing of the second laser light without controlling the rotation phase relation based on the data relating to the amount of skew and the detection result of the color registration detection toner image detected by the first optical sensor and the second optical sensor.

Further features of the present invention will become apparent from the following description of exemplary embodiments (with reference to the attached drawings).

DESCRIPTION OF THE EMBODIMENTS

Now, in the following, embodiments are described in detail with reference to the accompanying drawings.

<Configuration of Image Forming Apparatus>

Figure 1:
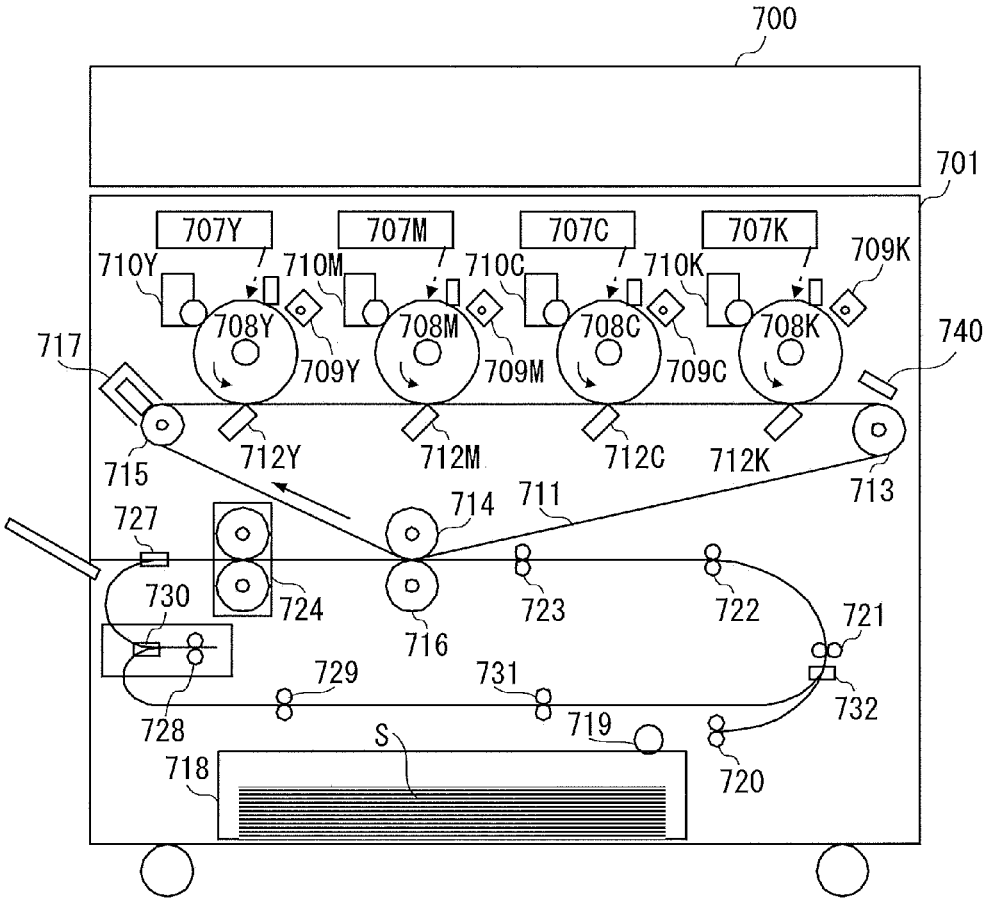
FIG. 1 is a configuration diagram of an image forming system.

FIG. 1 is a configuration diagram of an image forming system. The image forming system comprises an image reading apparatus 700 for reading an original image and an image forming apparatus 701. The image reading apparatus 700, comprising a platen, reads the image of the original placed on the platen and transmits the image read to the image forming apparatus 701 as image data.

The image forming apparatus 701 forms the images of each color, i.e., yellow (Y), magenta (M), cyan (C) and black (K). By overlapping the images of each color, the color image is formed. To form the color image, the image forming apparatus 701 comprises laser scanners 707Y, 707M, 707C, and 707K, and drum-shaped photoreceptors 708Y, 708M, 708C and 708K, and an intermediate transfer belt 711. It is noted that, in this embodiment, alphabets Y, M, C, and K, placed at the end of the reference numerals respectively represent yellow (Y), magenta (M), cyan (C), and black (K).

The laser scanners 707Y, 707M, 707C, and 707K emits laser light according to the image data. The laser scanners 707Y, 707M, 707C, and 707K irradiate the photoreceptors 708Y, 708M, 708C and 708K by the laser light emitted from the respective laser scanners to form electrostatic latent images. Chargers 709Y, 709M, 709C, and 709K and developing units 710Y, 710M, 710C and 710K are provided around the photoreceptors 708Y, 708M, 708C and 708K respectively. The photoreceptors 708Y, 708M, 708C and 708K rotate in an arrow direction in the drawing. The chargers 709Y, 709M, 709C, and 709K are provided on the upstream side in the rotation direction. The developing units 710Y, 710M, 710C and 710K are provided on the downstream side in the rotation direction.

The chargers 709Y, 709M, 709C, and 709K uniformly charge the surface of the photoreceptors 708Y, 708M, 708C and 708K. With the surface of the photoreceptors 708Y, 708M, 708C and 708K being charged, the laser light is irradiated to the photoreceptors 708Y, 708M, 708C and 708K. Then, the electrostatic latent images are formed on the photoreceptors 708Y, 708M, 708C and 708K. Each of the developing units 710Y, 710M, 710C and 710K include toners having corresponding colors. The toners are adhered to the electrostatic latent images formed on the photoreceptors 708Y, 708M, 708C and 708K and developed. Then, the toner images are formed on the photoreceptors 708Y, 708M, 708C and 708K. The developing units 710Y, 710M, 710C and 710K respectively comprise development sleeve for adhering the toner on the surface of the photoreceptors 708Y, 708M, 708C and 708K, a development paddle for scooping up and stirring the toner, and the like.

The intermediate transfer belt 711 is tensioned by a drive roller 713 and driven rollers 714 and 715. The intermediate transfer belt 711 is an intermediate transfer member which is rotationally driven in an arrow direction in the drawing.

Transfer bias blades 712Y, 712M, 712C, and 712K are respectively positioned to face the photoreceptors 708Y, 708M, 708C and 708K interposing the intermediate transfer belt 711 therebetween. Primary transfer sections are respectively formed between the transfer bias blades 712Y, 712M, 712C, and 712K and the photoreceptors 708Y, 708M, 708C and 708K. The transfer bias blades 712Y, 712M, 712C, and 712K transfer the toner images formed on the photoreceptors 708Y, 708M, 708C and 708K to the intermediate transfer belt 711. An image detection sensor 740 is provided on the downstream side in the rotation direction of the intermediate transfer belt 711 looking from the transfer bias blades 712Y, 712M, 712C, and 712K. The image detection sensor 740 is an optical sensor which detects density of the image of each color or image forming position using a test image transferred to the intermediate transfer belt 711. A transfer bias roller 716 is positioned to face the driven roller 714 interposing the intermediate transfer belt 711 therebetween. The transfer bias roller 716 is detachably provided from the intermediate transfer belt 711. A secondary transfer section is formed between the transfer bias roller 716 and the driven roller 714. The transfer bias roller 716 and the driven roller 714 transfer the toner image having formed on the intermediate transfer belt 711 to the sheet S. A belt cleaner 717 is provided to face the driven roller 715 interposing the intermediate transfer belt 711 therebetween. The belt cleaner 717 collects the toner not transferred to the sheet S and remaining on the intermediate transfer belt 711. The belt cleaner 717 is separated from the intermediate transfer belt 711 from the start of the image forming processing to the end of transferring the toner image to the intermediate transfer belt 711. Thereafter, the belt cleaner 711 contacts the intermediate transfer belt 711 at a predetermined timing.

The sheet S is a recording medium stored in the sheet feeding cassette 718. The sheet S is picked up one by one from the sheet feeding cassette 718 by the sheet feeding roller 719. Then, the sheet S is conveyed to the secondary transfer section by conveyance rollers 720 to 723. The toner image having formed on the intermediate transfer belt 711 is transferred to the sheet S in the secondary transfer section. A fixing section 724 heats and pressurizes the sheet S having the toner image transferred thereto to fix the toner image on the sheet S. The sheet S is delivered outside the image forming apparatus 701 from the fixing section 724. By the processing as above, the image forming processing on the sheet S is finished. It is noted that, when double-sided printing is performed on the sheet S, the sheet S is conveyed by conveyance rollers 728, 729, and 731 in the direction guided by flappers 727, 730, and 772 and then, transferred again to the secondary transfer section.

In the image forming apparatus 701 configured as above, formation of yellow, magenta, cyan, and black images are performed in order. After the formation of yellow image is started, the formation of magenta image is started. The start of forming the magenta image delays according to the rotation speed of the intermediate transfer belt 711 and distance between the photoreceptor 708Y and the photoreceptor 708M. Similarly, after the formation of magenta image is started, the formation of cyan image is started. The start of forming the cyan image delays according to the rotation speed of the intermediate transfer belt 711 and distance between the photoreceptor 708M and the photoreceptor 708C. After the formation of cyan image is started, the formation of black image is started. The start of forming the black image delays according to the rotation speed of the intermediate transfer belt 711 and distance between the photoreceptor 708C and the photoreceptor 708K.

Based on the image data, the laser scanners 707Y, 707M, 707C, and 707K scan the photoreceptors 708Y, 708M, 708C and 708K with the laser light in order, which corresponds to the order in which the image formation of each color is started. Due to this, the electrostatic latent images are sequentially formed on the photoreceptors 708Y, 708M, 708C and 708K. An example is given when the yellow image is formed. When the formation of the electrostatic image is started on the photoreceptor 708Y, the development sleeve of the developing unit 701Y rotates and development bias is applied. When developing the electrostatic image is completed, the developing unit 701Y becomes an inoperable state. The same also applies to the rest of the developing units 710M, 710C, and 710K. Each of the photoreceptors 708Y, 708M, 708C and 708K, the laser scanners 707Y, 707M, 707C, and 707K, and the developing units 710Y, 710M, 710C and 710K forms the image forming unit which forms the toner image. The yellow toner image, formed on the photoreceptor 708Y, is transferred to the intermediate transfer belt 711. The toner images of magenta, cyan, and black are sequentially formed on the photoreceptors 708M, 708C, and 708K and transferred to the intermediate transfer belt 711. By overlappingly transferring the toner images of each color onto the intermediate transfer belt 711, full color toner image is formed on the intermediate transfer belt 711.

(Configuration of a Laser Scanner)

Figure 2:
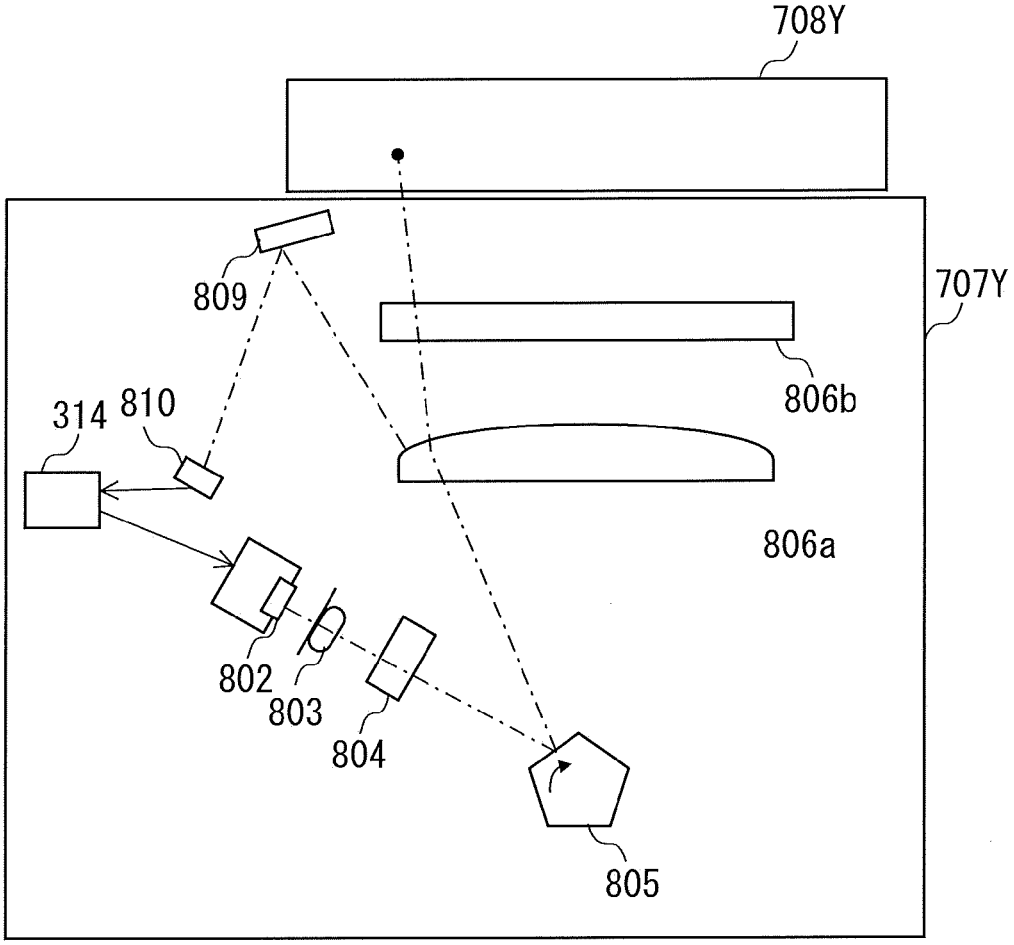
FIG. 2 is a configuration diagram of a laser scanner.

FIG. 2 is a configuration diagram of the laser scanner 707Y. The configuration of the rest of the laser scanners 707M, 707C, and 707K is similar to that of the laser scanner 707Y so that the description thereof will be omitted. The laser scanner 707Y comprises a light source 802, a collimator lens 803, a cylindrical lens 804, a polygon mirror 805, scanning lenses 806*a*, 806*b*, a synchronization detection mirror 809, a BD sensor 810, and a laser scanner control unit 314.

The light source 802 has one or more light emitting elements, for example, 32 light emitting elements, which emits laser light. The laser light emitted from the light source 802 passes through the collimator lens 803 and the cylindrical lens 804 and guided to the polygon mirror 805. The polygon mirror 805 is a rotating polygon mirror having one or more reflection surfaces (in this embodiment, five surfaces), which, in this embodiment, is rotationally driven in a clockwise direction. The polygon mirror 805 reflects the laser light guided by the light source 802. The polygon mirror 805 reflects the laser light while rotating. The reflection angle changes according to the rotation. Due to this, the reflection light of the laser light passes through the scanning lenses 806*a* and 806*b* and scans on the photoreceptor 708Y. Further, before the reflection light scans on the photoreceptor 708Y, the reflection light is passed through the end of the scanning lens 806*a*, is reflected by the synchronization detection mirror 809, and is input to the BD sensor 810. The BD sensor 810 detects the reflection light and inputs BD signal, which is pulse signal, to the laser scanner control unit 314. When scanning is started, the reflection light is input to the BD sensor 810. In response to this, the laser scanner control unit 314 detects start of scanning. Rotation of the polygon mirror 805 is controlled such that the BD signal is output in a constant period.

(Controller)

Figure 3:
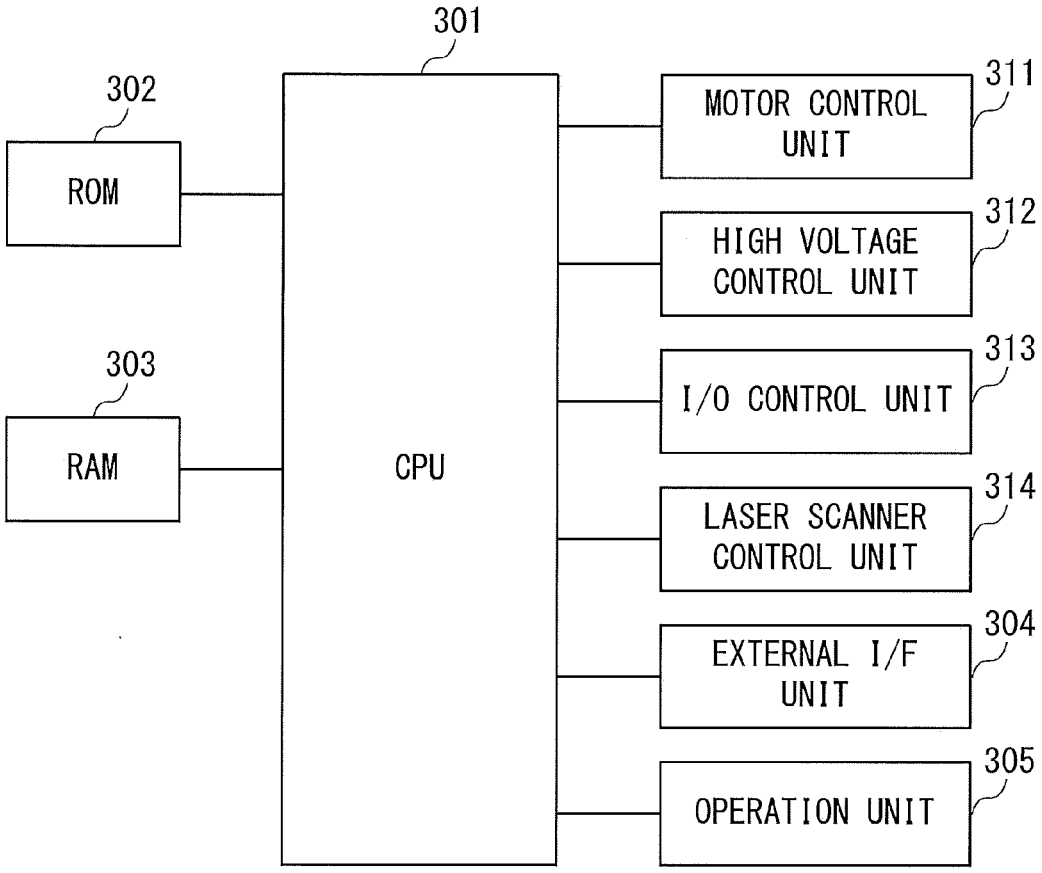
FIG. 3 is a configuration diagram of a controller.

FIG. 3 is a configuration diagram of a controller for controlling an entire operation of the image forming apparatus 701. The controller controls the operation of the image forming apparatus 701 by a central processing unit (CPU) 301, a read only memory (ROM) 302, and a random access memory (RAM) 303. In addition, the controller comprises an external interface (I/F) unit 304, an operation unit 305, a motor control unit 311, a high voltage control unit 312, an I/O control unit 313, and a laser scanner control unit 314.

The CPU 301 controls the operation of the image forming apparatus 701 by reading computer program stored in the ROM 302 and executing the computer program using the RAM 303 as a work area to execute the image forming processing as mentioned above. The external I/F unit 304 is an interface for establishing communication with the external devices. In addition to the image reading apparatus 700, the image forming unit 701 can obtain the image data used to the image forming processing from the external device via the external I/F unit 304. The operation unit 305 is an input interface for obtaining an instruction from a user. The motor control unit 311 drives various motors in the image forming apparatus 701 by the control of the CPU 301. By controlling the speed of each motor and rotation direction, the motor control unit 311 controls the speed and rotation direction of the roller or photoreceptors 708Y, 708M, 708C, 708K and the like connected to the motor. The high voltage control unit 312 controls the high voltage used for development, charging, transferring and the like by the control of the CPU 301. The I/O control unit 313 inputs detection result detected by the sensors such as an image detection sensor 740 in the image forming apparatus 701 to the CPU 301 and transmits an instruction from the CPU 301 to each unit in the image forming apparatus 701. The laser scanner control unit 314 controls the laser scanners 707Y, 707M, 707C, and 707K by the control of the CPU 301. In particular, the laser scanner control unit 314 controls the rotation of the polygon mirror 805 of each of the laser scanners 707Y, 707M, 707C, and 707K and adjusts a writing start position or magnification of the image.

The image forming system having the above configuration performs image forming processing by the control of the controller. Further, the image forming system performs correction to adjust image quality such as color registration correction, toner density correction and the like.

(Color Registration Correction)

Due to changes in various heat sources including power source, heater in the fixing unit 724, motors in each unit and the like which operate when forming images and changes in surrounding environment, in the image forming apparatus 701, positions to exposure laser light to the photoreceptors 708Y, 708M, 708C and 708K change. Due to this, the toner image forming position on each of the photoreceptors 708Y, 708M, 708C and 708K registrates and the so-called "color registration" occurs. Thus, the image forming apparatus 701 needs to regularly perform color registration correction to eliminate the color registration. Using a test image for measuring the color registration (position registration amount of the image forming position of each color), the color registration correction is performed. The test image is hereinafter referred to as "color registration detection toner image". Using the color registration detection toner image, relative positional relation between the toner images of each color can be detected.

Figure 4:
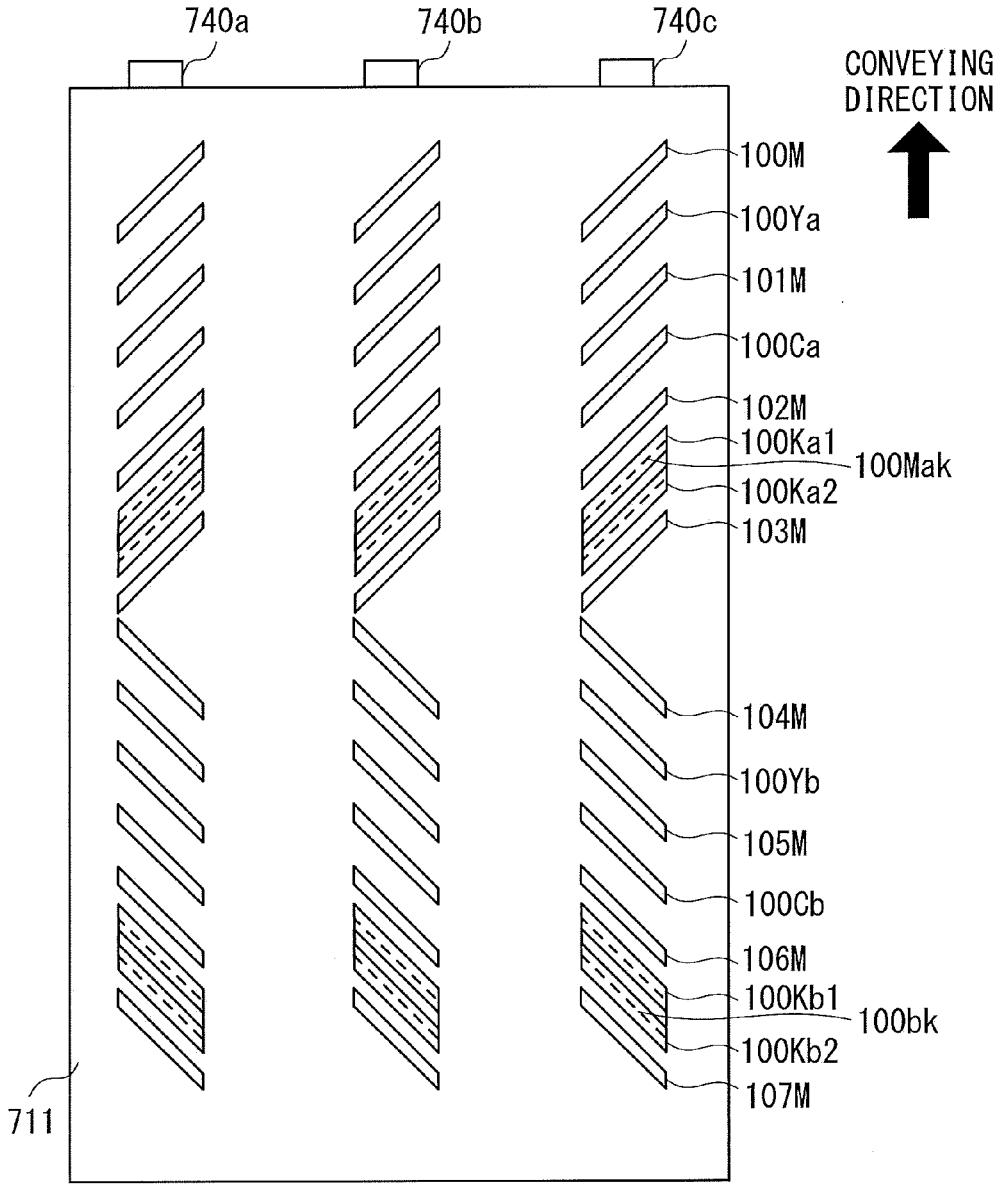
FIG. 4 is a diagram illustrating color registration detection toner image.

FIG. 4 is a diagram illustrating the color registration detection toner image. FIG. 4 represents the color registration detection toner image formed on the intermediate transfer belt 711, in which, three image detection sensors 740*a*, 740*b*, and 740*c* are provided at different positions (i.e., both ends and center of the intermediate transfer belt 711) in a width direction of the intermediate transfer belt 711. The "width direction" of the intermediate transfer belt 711 represents a direction which is almost orthogonal to the conveying direction (rotation direction) of the intermediate transfer belt 711. That is, it is the direction which is almost orthogonal so that it crosses in a direction in which the surface of the intermediate transfer member moves. In relation with the photoreceptors 708Y, 708M, 708C and 708K, the "width direction" corresponds to the direction in which the photoreceptors 708Y, 708M, 708C and 708K are scanned (main scanning direction). The "conveying direction" of the intermediate transfer belt 711 corresponds to a "sub-scanning direction".

The images 100Ya and 100Yb are the images to detect the color registration of yellow. The images 100Ca and 100Cb are the images to detect the color registration of cyan. The images 100Ka1, 100Ka2, 100Kb1, and 100Kb2 are the images to detect the color registration of black. The images 100M to 107M, 100Mak, and 100Mbk are the images of magenta. Based on the images of magenta, image forming positions of the rest of the colors are determined. According to the positions detected by the image detection sensors 740*a*, 740*b* and 740*c*, each image is formed on the intermediate transfer belt 711. In the present embodiment, based on the magenta images 100M to 107M, 100Mak, and 100Mbk, position registration amount of the image of the rest of the colors is detected. It is noted that the image detection sensors 740*a*, 740*b*, and 740*c* of the present embodiment are incapable of detecting the black images 100Ka1, 100Ka2, 100Kb1, and 100Kb2. Thus, in the color registration detection toner image in FIG. 4, the black images 100Ka1, 100Ka2, 100Kb1, and 100Kb2 are formed on the magenta images 100Mak and 100Mbk. By detecting the position of the magenta images 100Mak and 100Mbk, the image detection sensors 740*a*, 740*b*, and 740*c* can detect the black images 100Ka1, 100Ka2, 100Kb1, and 100Kb2.

Figure 5:
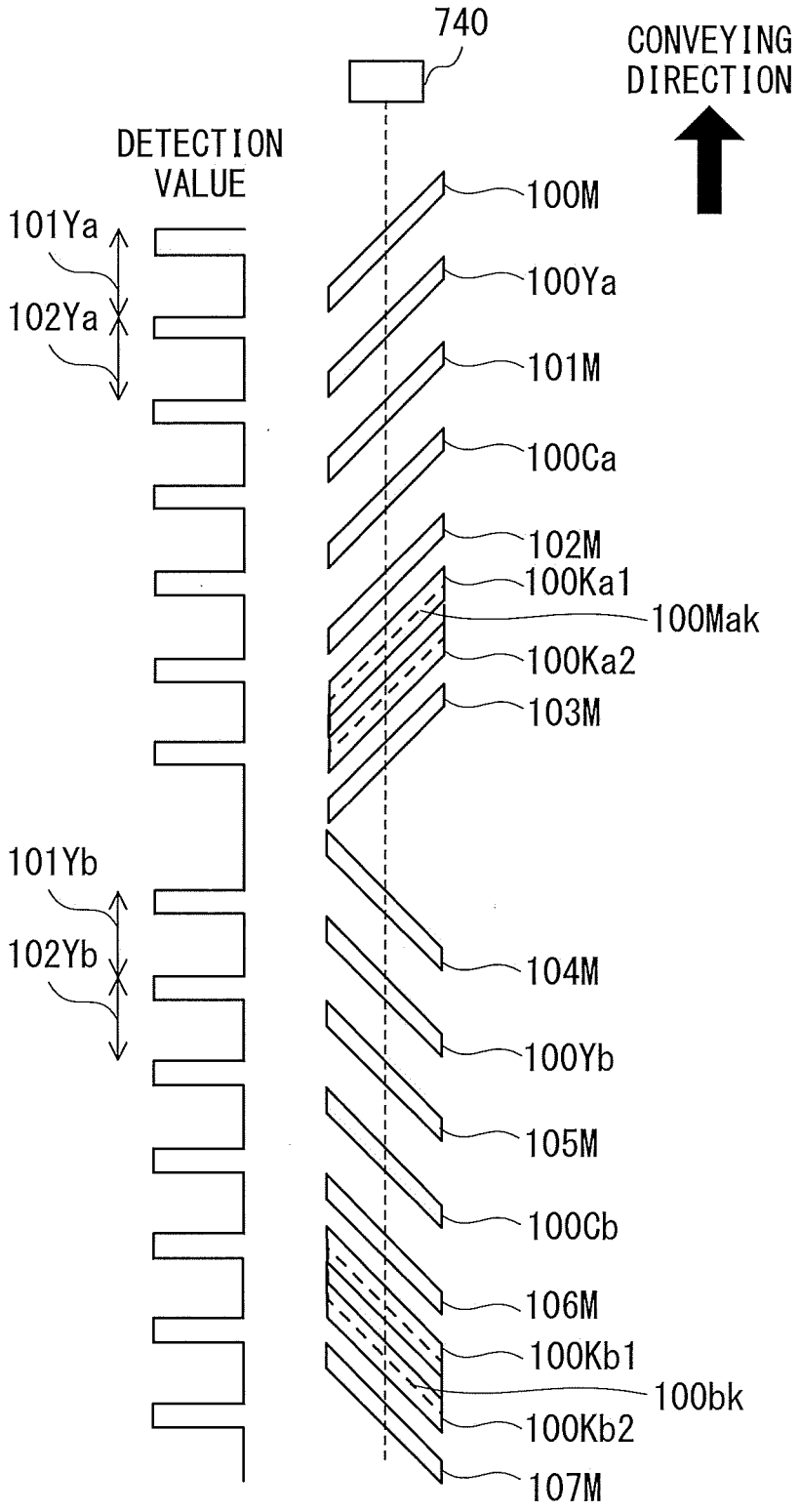
FIG. 5 is a diagram explaining how to detect position registration amount.

FIG. 5 is a diagram for explaining how the position registration amount of the yellow image is detected. The image detection sensor 740 detects binary data (detection value) by detecting the position at which the color registration detection toner image is formed. The detection value represents distance 101Ya, 102Ya, 101Yb, and 102Yb between the images of the color registration detection toner image. The distance 101Ya is the distance between the magenta image 100M and the yellow image 100Ya. The distance 102Ya is the distance between the yellow image 100Ya and the magenta image 101M. The distance 101Yb is the distance between the magenta image 104M and the yellow image 100Yb. The distance 102Yb is the distance between the yellow image 100Yb and the magenta image 105M. Based on the detected distance 101Ya, 102Ya, 101Yb, and 102Yb, the position registration amount in the main scanning direction (main scanning registration amount) and the position registration amount in the sub-scanning direction (sub-scanning registration amount) of the yellow image can be calculated by the following expression. It is noted that, through the expression, the position registration amounts in the main scanning direction and sub-scanning direction of the cyan image and the black image can be calculated in a similar manner.

$$\text{(main scanning registration amount)}=\{(102Ya-101Ya)/2-(102Yb-101Yb)/2\}/2$$

$$\text{(sub-scanning registration amount)}=\{(102Ya-101Ya)/2+(102Yb-101Yb)/2\}/2$$

The controller obtains the main scanning registration amount and the sub-scanning registration amount of each color based on the detection values detected by the three image detection sensors 740*a*, 740*b*, and 740*c*. According to the main scanning registration amount and the sub-scanning registration amount of each color, the controller corrects writing start timing and magnification in the main scanning direction, and writing start timing and inclination in the sub-scanning direction. The writing start timing in the main scanning direction and the writing start timing in the sub-scanning direction are determined based on the emission timing of the laser light from the light source 802 and rotation phase of the polygon mirror 805. A position to form the image (an image forming position) is determined by the writing start timing in the main scanning direction and the writing start timing in the sub-scanning direction. The controller performs the color registration correction processing in a predetermined period. For example, the processing is performed when the number of the sheets S having the image forming processing performed thereto reaches 1000 sheets or when there is a change of 2 degrees or higher in an environmental temperature since the previous color registration correction processing.

(Skew Correction of Sheet S)

Figure 6:
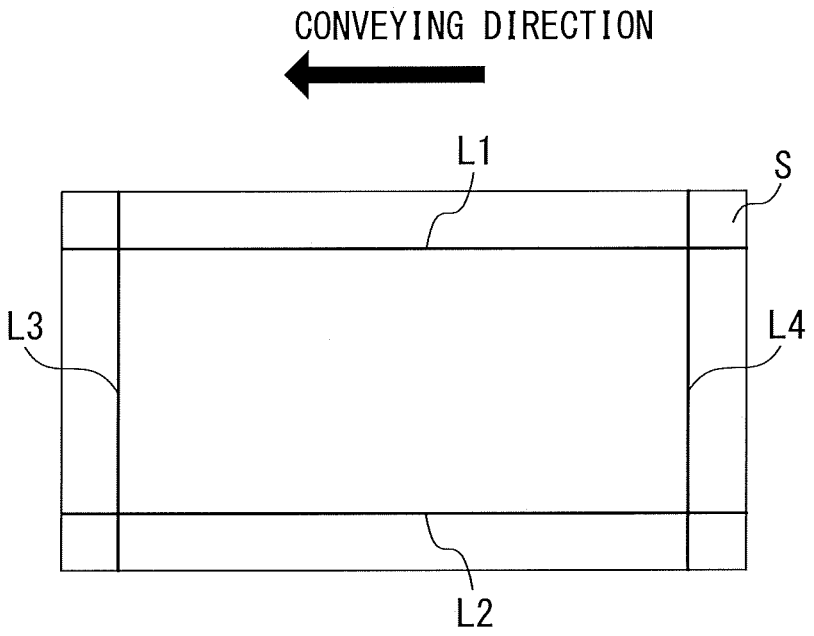
FIG. 6 is a diagram in which straight lines are formed to the sheet which is not skewed.
Figure 7:
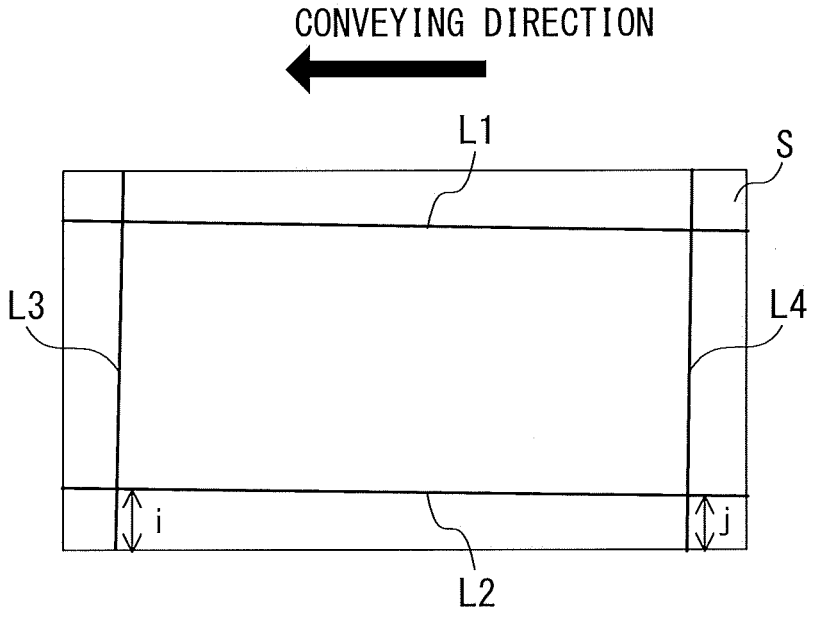
FIG. 7 is a diagram in which straight lines are formed on the sheet which is skewed.

If the sheet S is conveyed to the secondary transfer section in a skew state, the toner image is not transferred to the correct position on the sheet S from the intermediate transfer belt 711. Thus, the controller performs the skew correction. The skew correction is to correct the image data in such a manner that the toner image is inclined and formed to correspond to the amount of skew of the sheet S. In the present embodiment, the user measures the amount of skew of the sheet S and inputs the measured amount to the image forming apparatus 701. Here, "correspond" means a matching state where the amount of skew of the sheet S to be conveyed to the secondary transfer section matches the amount of skew of the toner image transferred to the intermediate transfer belt 711. The skew of the toner image which is transferred to the sheet S in the matching state is suppressed as compared with the skew of the toner image in a case where both of the amounts of the skew do not match (i.e., without correction). FIG. 6 is a diagram in which straight lines L3 and L4, extending in the main scanning direction and straight lines L1 and L2, extending in the sub-scanning direction are formed with respect to the sheet S, which is not skewed. FIG. 7 is a diagram in which straight lines L3 and L4, extending in the main scanning direction and straight lines L1 and L2, extending in the sub-scanning direction are formed with respect to the sheet S, which is skewed. The straight lines L1 to L4 are test patterns for measuring the amount of skew of the sheet S. In FIG. 7, since the straight lines L1 to L4 are obliquely formed with respect to the sides of the sheet S, the user can recognize the occurrence of sheet-feed skew. The user measures the distance i and j, which is the distance between the straight line L2 and the side of the sheet S. Then, the user inputs the measured results to the controller by the operation unit 305. The controller stores the distance i and j input in the RAM 303 as the data relating to the amount of skew of the sheet S. The data stored is used for skew correction of the sheet S. It is noted that the sensor may be provided near a delivery port of the sheet S of the image forming apparatus 701 and the distance i and j may be measured by the sensor.

Figures 8A, 8B, 8C:
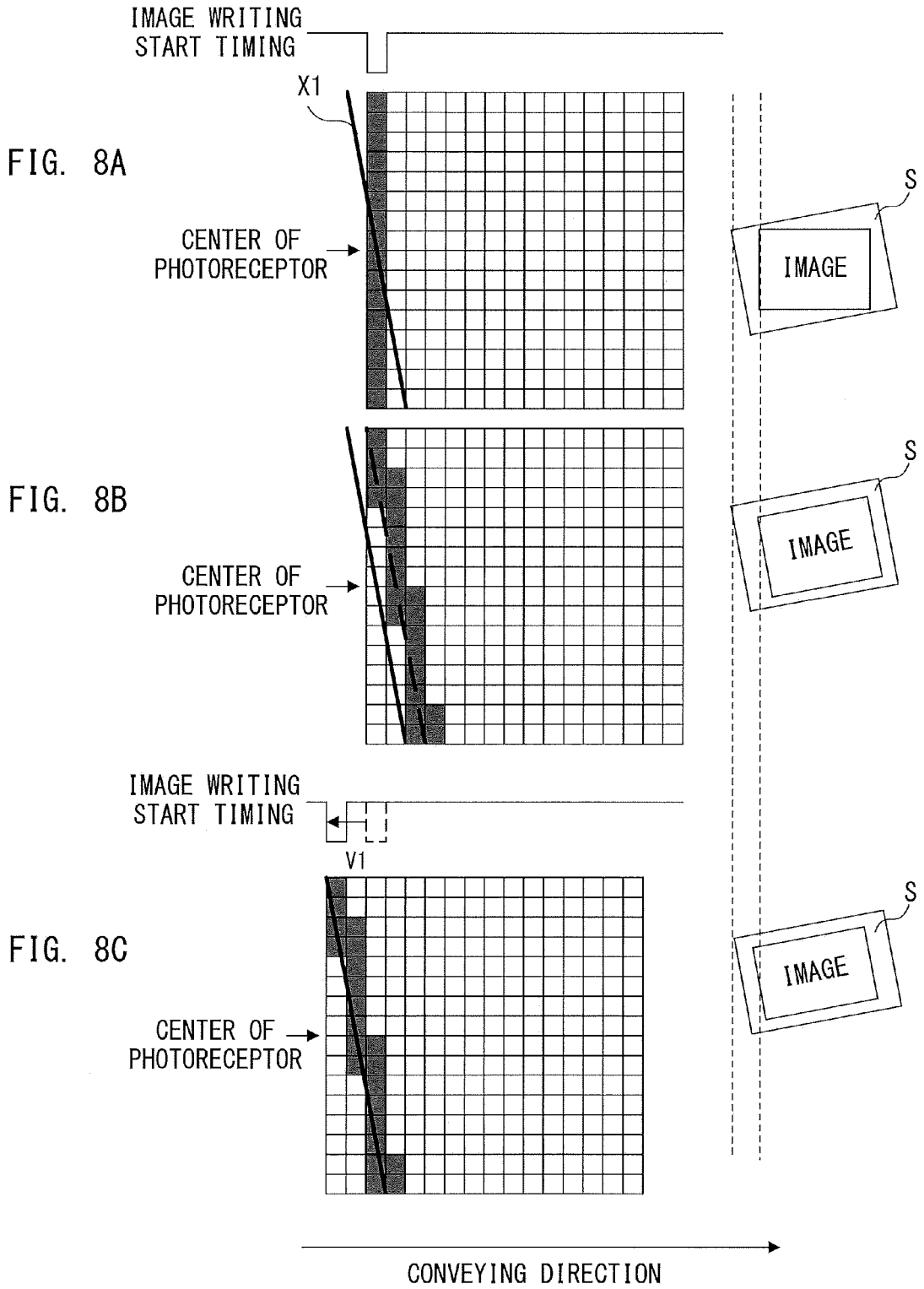
FIGS. 8A to 8C are diagrams explaining skew correction.

FIGS. 8A to 8C are diagrams explaining the skew correction performed to a linear image extending in the main scanning direction having a width of one pixel in the sub-scanning direction (conveying direction). FIG. 8A represents a case where the image is formed without performing the skew correction. Since the sheet S is skewed during the conveyance, the image is formed obliquely to the sheet S. FIG. 8B represents a case where the skew correction is performed and the image data is corrected to incline the image by an inclination of X1 according to the inclination of the sheet S. Since the image is inclined and formed according to the skew of the sheet S, the image is formed in a right direction to the sheet S. However, the image forming position to the sheet is not correct. By correcting the image data so as to adjust the writing start timing in the sub-scanning direction, the image forming position is changed. FIG. 8C represents a case where the writing start timing in the sub-scanning direction is advanced by a time V1. By advancing the writing start timing in the sub-scanning direction by the time V1, the image is formed in the direction and the position according to the skew of the sheet S.

Figures 9A, 9B, 9C:
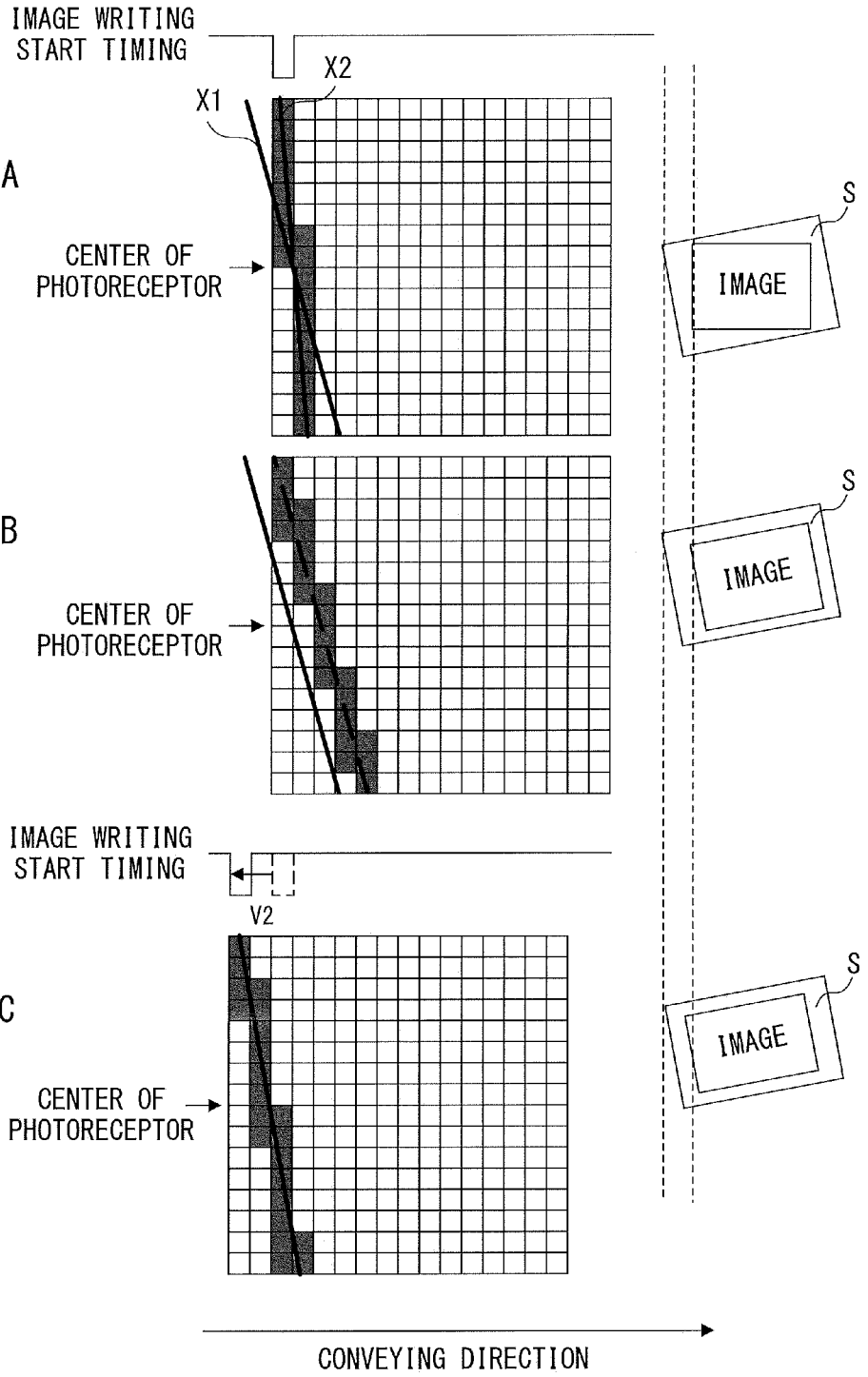
FIGS. 9A to 9C are diagrams explaining the skew correction and color registration correction.

FIGS. 9A to 9C are diagrams explaining the skew correction and the color registration correction performed to a linear image extending in the main scanning direction having a width of one pixel in the sub-scanning direction (conveying direction). The position registration amount is obtained in a manner as explained in FIG. 5. FIG. 9A represents a case where the color registration correction is performed. By the color registration correction, the image data is corrected to incline the yellow image by an inclination of X2. This eliminates the color registration of the yellow image and the magenta image. However, since the skew correction is not performed, the image is still inclined to the sheet S. FIG. 9B represents a case where the skew correction is performed and the image data is corrected to incline the image by the inclination of X1 according to the inclination of the sheet S. Since the image is inclined and formed according to the skew of the sheet S, the image is formed in a right direction to the sheet S. FIG. 9C represents a case where the writing start timing in the sub-scanning direction is advanced by a time V2. By performing the color registration correction and the skew correction in the above mentioned manner, the image is formed in the direction and position according to the skew of the sheet S.

Figures 10A, 10B, 10C:
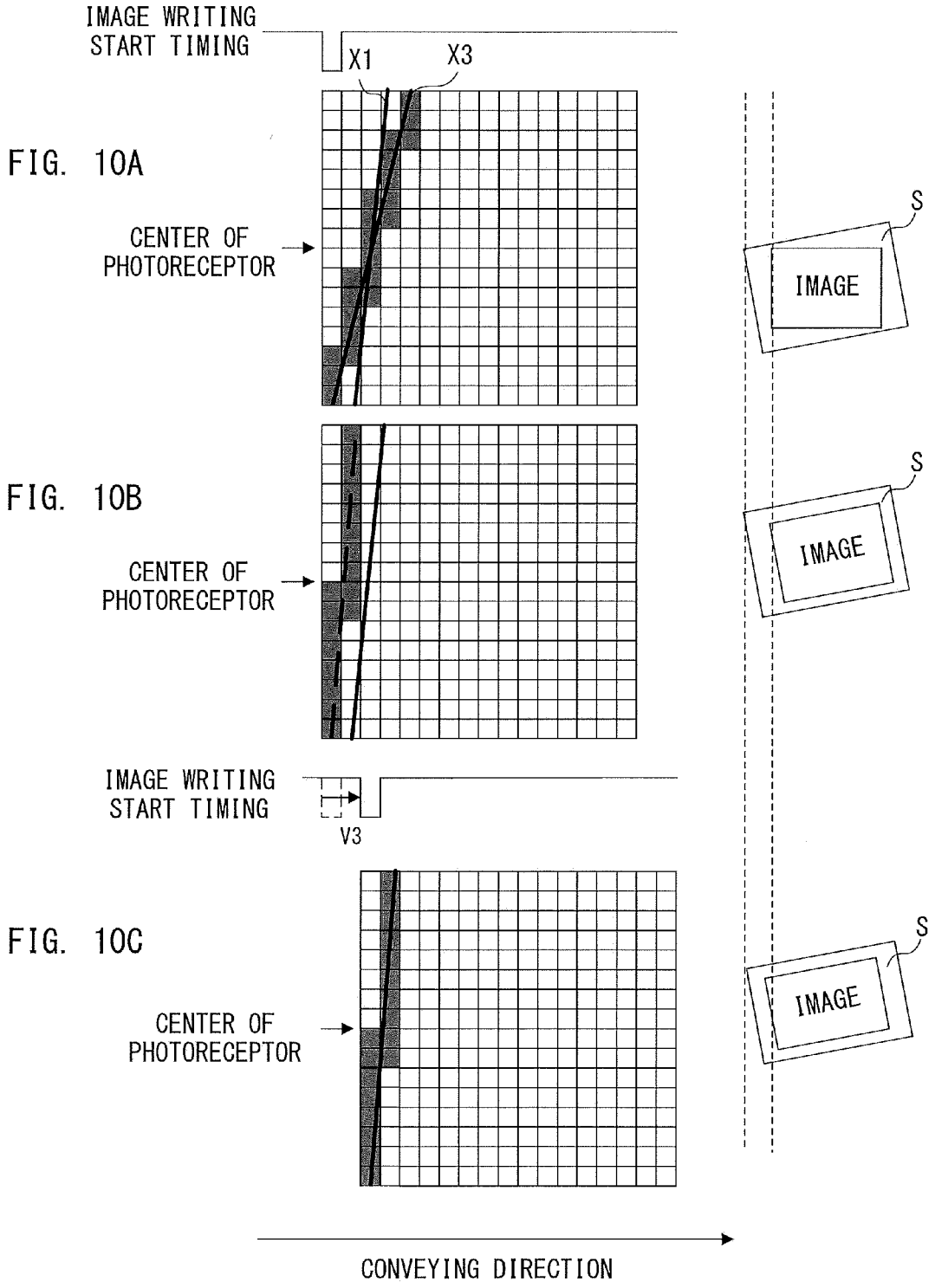
FIGS. 10A to 10C are diagrams explaining the skew correction and the color registration correction.

Similarly, the color registration correction of the cyan and black images is performed. FIGS. 10A to 10C are diagrams explaining the skew correction and the color registration correction using the linear cyan image extending in the main scanning direction for every one pixel in the sub-scanning direction (conveying direction). In FIG. 10A, the image data is corrected to incline the cyan image by an inclination of X3. This eliminates the color registration of the cyan image and the magenta image. However, since the skew correction is not performed, the image is still inclined to the sheet S. FIG. 10B represents a case where the skew correction is performed and the image data is corrected to incline the image by the inclination of X1 according to the inclination of the sheet S. Since the image is inclined and formed according to the skew of the sheet S, the image is formed in a right direction to the sheet S. FIG. 10C represents a case where the writing start timing in the sub-scanning direction is delayed by a time V3. By performing the color registration correction and the skew correction in the above mentioned manner, the image is formed in a right direction and position to the sheet S.

As mentioned, by performing the skew correction to the sheet S, the writing start timing in the sub-scanning direction (writing start position) differs for every color. Thus, 1) the rotation phase relations among the respective polygon mirrors 805 corresponding to the colors for forming the toner image and 2) the emission timing of the laser light from the light source 802 are controlled for every color.

(Density Correction)

Figure 11:
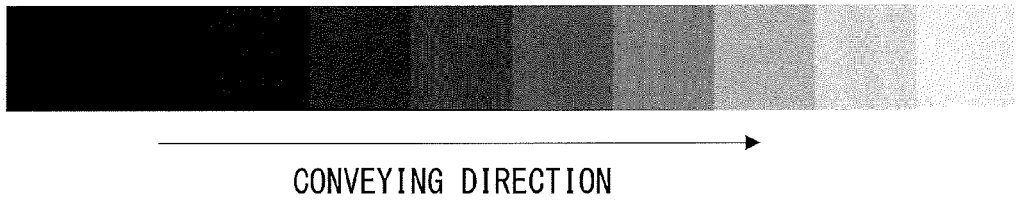
FIG. 11 is a diagram illustrating density detection toner image.

Due to changes in the environmental temperature or humidity, the maximum density and the density gradation characteristic of the image to be formed by the image forming apparatus 701 change accordingly. Thus, the image forming apparatus 701 controls the density correction of the image by detecting the density of the image of each color from the density correction test image formed on the photoreceptors 708Y, 708M, 708C, and 708K or on the intermediate transfer belt 711 and correcting the gradation characteristics according to the detection result. The density correction test image is hereinafter referred to as "density detection toner image". FIG. 11 is a diagram illustrating the density detection toner image.

The density detection toner image is an image in which the density in the image gradually changes. The density detection toner image is formed on the intermediate transfer belt 711. By the image detection sensor 740, the density of the density detection toner image is detected. The density detection toner image, formed for every color, is formed in the width direction of the intermediate transfer belt 711 at a position where is different from where the color registration detection toner image is formed. Four image detection sensors 740 for detecting the density detection toner image are provided corresponding to the density detection toner image for every color. The controller generates a look up table (LUT) for performing γ correction according to the detection result such that the density of the image of each color detected by the four image detection sensors 740 matches a target table representing the density of the target image. When correcting the density, the controller corrects the image data according to the generated LUT. The controller performs the density correction processing in a predetermined period. For example, the processing is performed when the number of the sheet S having the image forming processing performed thereto reaches 80 sheets.

(Writing Start Timing in the Sub-Scanning Direction)

Figure 12A:
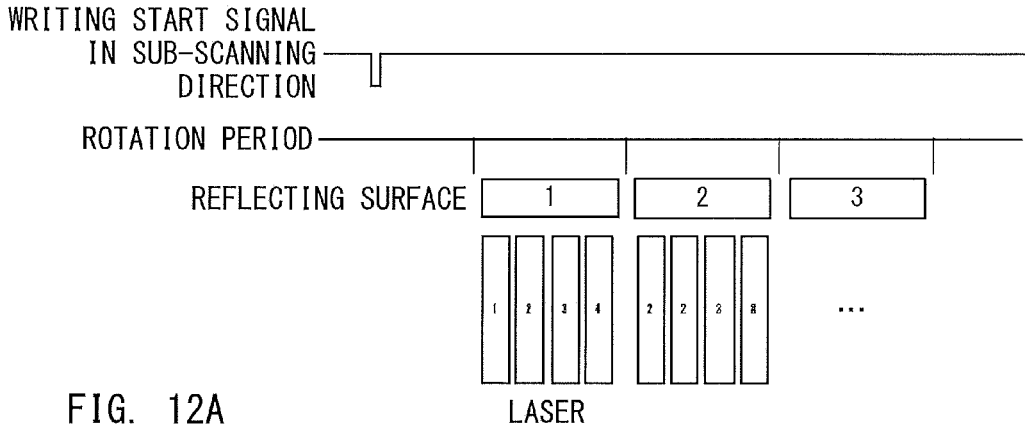
FIGS. 12A to 12C are diagrams explaining writing start timing in the sub-scanning direction.
Figure 12B:
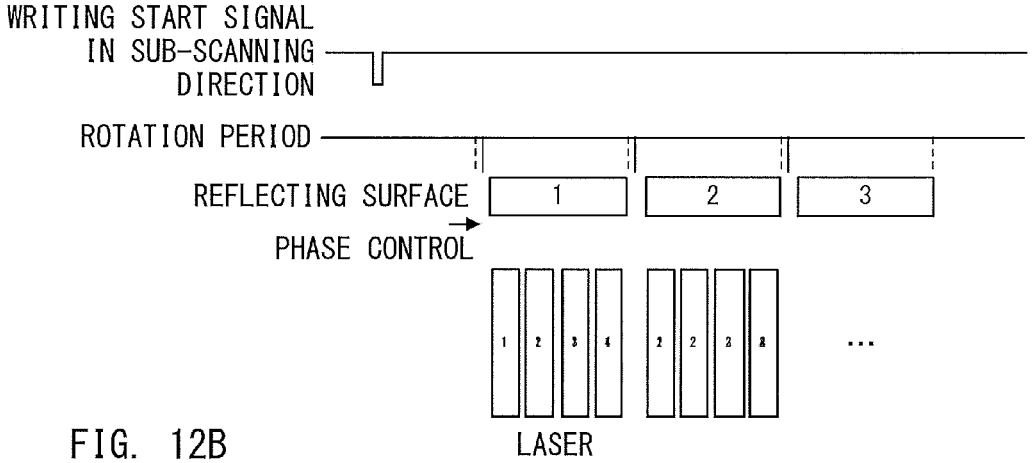
Figure 12C:
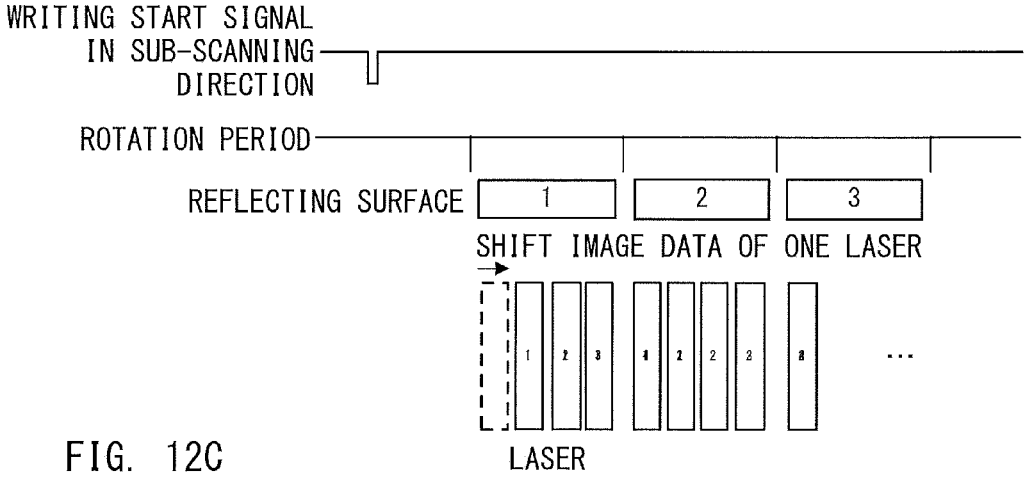

FIGS. 12A to 12C are diagrams explaining the writing start timing in the sub-scanning direction. Depending on the writing start timing in the sub-scanning direction, the image forming position in the sub-scanning direction is determined. In the present embodiment, a case where scanning of four laser lights (four pixels in the sub-scanning direction) is performed at a time on one side of the polygon mirror.

The laser scanners 707Y, 707M, 707C, and 707K emit the laser light at a timing according to a writing start signal in the sub-scanning direction to be transmitted from the controller (CPU 301) via the laser scanner control unit 314. FIG. 12A represents a state where the four laser lights are emitted in accordance with the rotation period of the polygon mirror 805. The four laser lights are irradiated to each reflecting surface.

Figure 13:
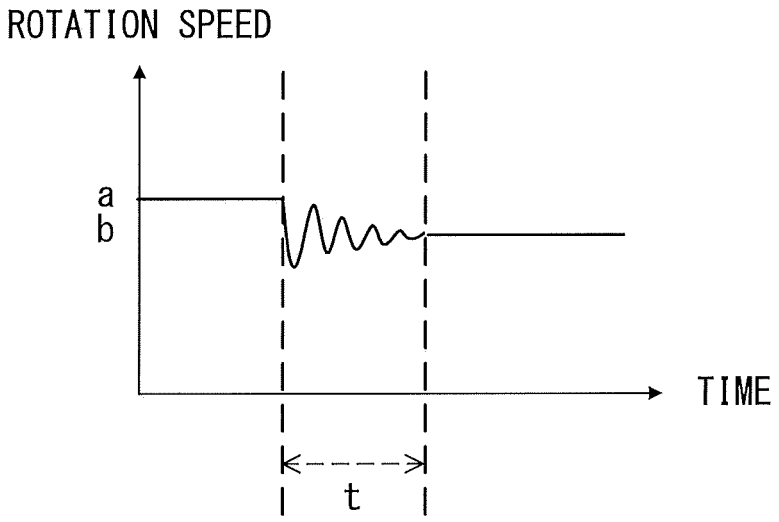
FIG. 13 is a diagram representing change in rotation speed of polygon mirror.

FIG. 12B represents a state where the writing start timing in the sub-scanning direction is corrected by changing the rotation phase of the polygon mirror 805. In FIG. 12B, the rotation phase is changed from the rotation period represented by the dashed line to the rotation period represented by the solid line. Due to the change of the rotation phase of the polygon mirror 805, it is possible to correct the writing start timing (writing start position) in the sub-scanning direction of less than one pixel. Thus, the image forming position is corrected by a unit less than an interval between scanning lines in the sub-scanning direction. FIG. 13 is a diagram representing changes in the rotation speed of the polygon mirror 805 when changing the rotation phase. As shown in FIG. 13, when the rotation speed of the polygon mirror 805 is changed from rotation speed a to rotation speed b, standby time t, required until the rotation of the polygon mirror 805 is stabilized, occurs.

FIG. 12C represents a case where the writing start timing in the sub-scanning direction is corrected by one pixel. When correcting the writing start timing in the sub-scanning direction by one pixel, the controller corrects the image data and adjusts the emission timing of the light source 802. To correct the image data, no standby time required until the rotation of the polygon mirror 805 is stabilized occurs, however, the correction of the writing start timing in the sub-scanning direction can be performed by only a unit one pixel. Thus, the image forming position is corrected by a unit of an interval between scanning lines in the sub-scanning direction.

As mentioned, the writing start timing in the sub-scanning direction is controlled by delaying or advancing the emission timing of the laser light by a unit of scanning period. As mentioned above, in case of the skew correction of the sheet S, the writing start timing in the sub-scanning direction differs for every color. If the correction of the writing start timing in the sub-scanning direction is performed by a unit of one pixel (FIG. 12C), color registration of one laser light (one pixel) may be caused between the colors. For example, when the image forming apparatus 701 performs image formation with 2400 [dpi], the color registration of 10.58 [μm], which corresponds to one pixel, may be caused between the colors. To prevent such color registration, as shown in FIG. 12*b*, the writing start timing in the sub-scanning direction is corrected by changing the rotation phase of the polygon mirror 805. By correcting the writing start timing in the sub-scanning direction, the image forming position shifts by a pixel unit in the sub-scanning direction.

If the color registration detection toner image is formed at the writing start timing in the sub-scanning direction at which the skew of the sheet S is corrected, the controller cannot accurately detect the position registration amount of the image of each color with respect to the basic color (magenta) formed on the intermediate transfer belt 711. Due to this, when forming the color registration detection toner image, the controller does not correct the writing start timing in the sub-scanning direction at which the skew of the sheet S is corrected. It means that, the phase of the polygon mirror 805 differs in a case where the image is formed on the sheet S and in a case where the color registration detection toner image is formed on the intermediate transfer belt 711. As a result, every time the image to be formed is changed, the standby time required until the rotation of the polygon mirror 805 is stabilized occurs.

When the image other than the color registration detection toner image is formed without being transferred to the sheet S, if the image is formed at the timing in the sub-scanning direction at which the color registration detection toner image is formed, the standby time required until the rotation of the polygon mirror 805 is stabilized further occurs. Thereby, when the image other than the color registration detection toner image is formed without being transferred to the sheet S, the writing start timing in the sub-scanning direction is set to correspond to the writing start timing in the sub-scanning direction at which the skew of the sheet S is corrected. Due to this, occurrence of further standby time is prevented.

Figure 14:
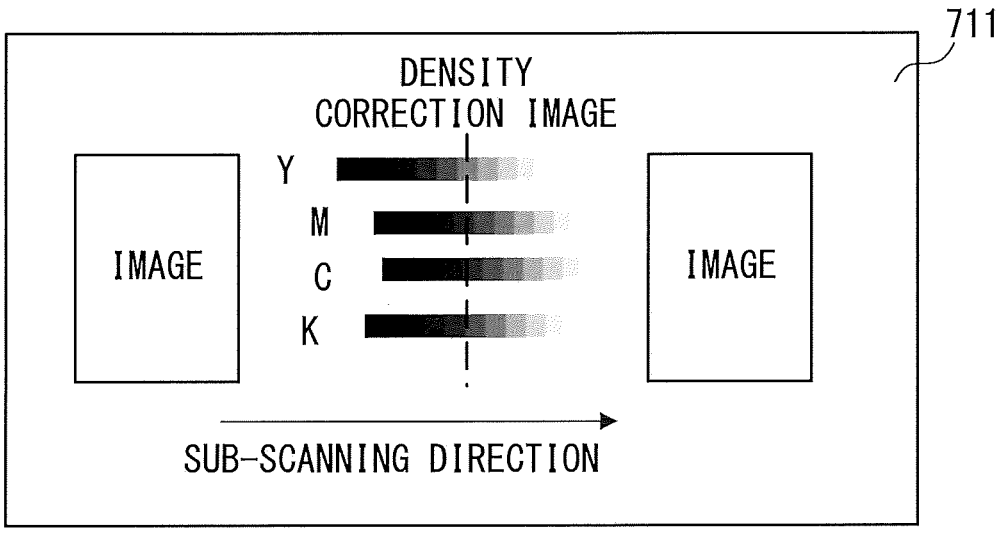
FIG. 14 is a diagram illustrating the density detection toner image formed on the intermediate transfer belt.

As mentioned, the processing to form the image without being transferred to the intermediate transfer belt 711 is performed when forming the color registration detection toner image. In addition, the processing is performed, for example, when forming the density detection toner image. When the image is formed at the writing start timing in the sub-scanning direction at which the skew correction is performed to the sheet S, as shown in FIG. 14, the density detection toner images are formed on the intermediate transfer belt 711 at different positions in the sub-scanning direction for every color. In FIG. 14, the density detection toner image of yellow is formed first, then, the formation of the density detection toner images of black, magenta, and cyan follow in order.

If the position where no density detection toner image is formed is sampled, the image detection sensor 740 cannot detect the image density accurately. Thus, it is desired that the timing to start sampling of the density detection toner image is accurately adjusted for every color to correspond the writing start timing in the sub-scanning direction of the density detection toner image with that of the color registration detection toner as much as possible.

The writing start timing of the color registration detection toner image in the sub-scanning direction is defined as Vstart [μm]. Also, the writing start timing of the sheet S according to the amount of skew in the sub-scanning direction is defined as Offset [μm]. A gap is caused between the image forming position when the image data is not corrected and the image forming position after the image data is corrected. The writing start timing is represented by the gap. The writing start timing in the sub-scanning direction when the image is formed on the sheet S is represented by "Vstart+Offset" [μm]. It means that when the image is formed on the sheet S, the color registration correction and the skew correction are performed.

The writing start timing in the sub-scanning direction of the density detection toner image is represented by the following expression: "Vstart+Offset−(Offset/Line)*Line". The "line" represents a length of one pixel. In this embodiment, it is 10.58 [μm]. The "Offset/Line" is an integer obtained by rounding down decimal points. This represents the number of pixels corresponding to the writing start timing in the sub-scanning direction corresponding to the amount of skew of the sheet S. In this case, description is made for the writing start timing in the sub-scanning direction of the image other than the color registration detection toner image formed on the intermediate transfer belt 711 without being transferred to the sheet S. This timing is shifted less than 10.58 [μm] to the writing start timing in the sub-scanning direction of the color registration detection toner image. Due to this, the image detection sensor 740 never samples the position where no image is formed.

(Sequence)

Figure 15:
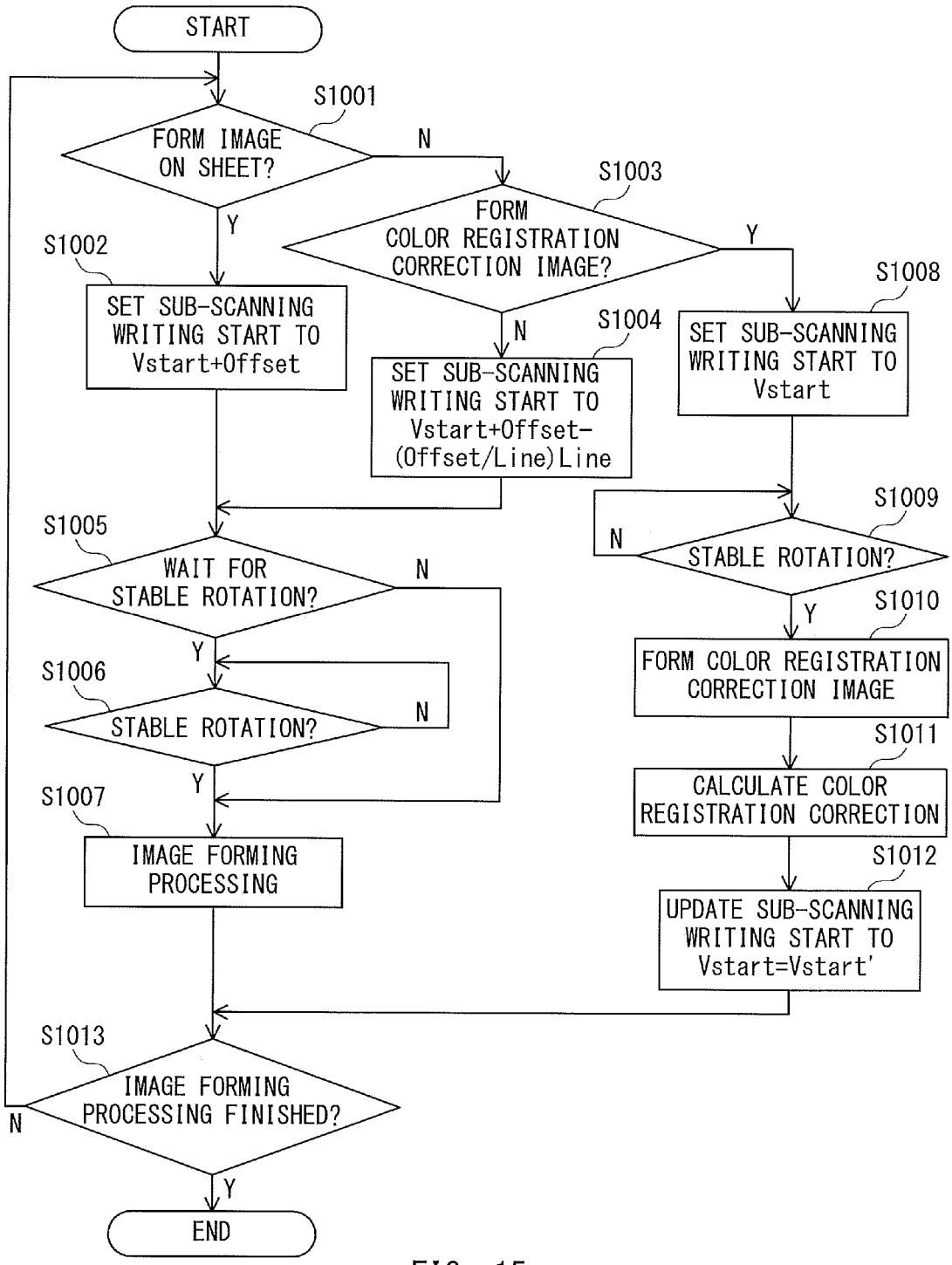
FIG. 15 is a flowchart representing image forming processing.

FIG. 15 is a flowchart representing image forming processing performed by determining the writing start timing in the sub-scanning direction.

The CPU 301 of the controller determines whether to perform the image formation to the sheet S or not (S1001). If, for example, an instruction to perform the image forming processing is given from a user through the operation unit 305, the CPU 301 determines to perform the image formation to the sheet S. When the color registration correction and the density correction are performed, the CPU 301 determines to perform the image forming processing without performing the image formation to the sheet S.

If the image formation is performed to the sheet S (S1001: Y), the CPU 301 sets the writing start timing in the sub-scanning direction to "Vstart+Offset". This is because the writing start timing in the sub-scanning direction needs to be corrected according to the amount of skew of the sheet S (S1002). Due to this, the CPU 301 can perform the image formation in which the skew of the sheet S and the color registration are corrected. If the image formation is not performed to the sheet S (S1001: N), the CPU 301 determines whether to form the color registration detection toner image (S1003). By determining whether or not to perform the color registration correction, the CPU 301 determines whether or not to form the color registration detection toner image. If the color registration image is not formed (S1003: N), the CPU 301 sets the writing start timing in the sub-scanning direction to "Vstart+Offset−(Offset/Line)*Line" according to the rotation phase of the polygon mirror 805 (S1004). For example, if the density detection toner image is formed, the CPU 301 sets the writing start timing in the sub-scanning direction as follows: "Vstart+Offset−(Offset/Line)*Line".

The CPU 301, having set the writing start timing in the sub-scanning direction, determines whether or not it is necessary to wait until the rotation of the polygon mirror 805 is stabilized (S1005). If the image formed immediately before is the color registration detection toner image, it is necessary to change the rotation phase of the polygon mirror 805 so that the CPU 301 needs to wait until the rotation of the polygon mirror 805 is stabilized. If it is determined that it is necessary to wait until the rotation of the polygon mirror 805 is stabilized (S1005: Y), the CPU 301 waits until the rotation of the polygon mirror 805 is stabilized (S1006). When the rotation of the polygon mirror 805 is stabilized (S1006: Y) or when it is not necessary to wait until the rotation of the polygon mirror 805 is stabilized (S1005: N), the CPU 301 performs the image forming processing (S1007).

When the color registration detection toner image is formed (S1003: Y), the CPU 301 sets the writing start timing in the sub-scanning direction to Vstart (S1008). The CPU 301, having set the writing start timing in the sub-scanning direction, waits until the rotation of the polygon mirror 805 is stabilized (S1009). The rotation phase of the polygon mirror 805 in the writing start timing in the sub-scanning direction of the color registration detection toner image differs from that in the writing start timing in the sub-scanning direction when forming other images. Thus, the CPU 301 needs to wait until the rotation of the polygon mirror 805 is stabilized. When the rotation of the polygon mirror 805 is stabilized (S1009: Y), the CPU 301 performs processing to form the color registration detection toner image (S1010).

According to the position registration amount detected by the image detection sensor 740 from the color registration detection toner image formed on the intermediate transfer belt 711, the CPU 301 calculates the writing start position in the sub-scanning direction based on the color registration correction (S1011). Based on the calculation result, the CPU 301 updates the writing start timing in the sub-scanning direction to Vstart' (S1012).

After the image forming processing (S1007), or after updating the writing start timing in the sub-scanning direction (S1012), the CPU 301 determines whether or not the image forming processing is finished (S1013). The CPU 301 determines that the image forming processing is not finished yet when the number of sheets having performed the image forming processing thereto does not reach the number of sheets instructed from the operation unit 305 or when the color registration correction or the density correction is performed after performing the image forming processing to the predetermined number of sheets (S1013: N). In this case, the CPU 301 repeats the processing after Step S1001. When the writing start timing in the sub-scanning direction is updated in Step S1012, the CPU 301 repeats the processing using the value updated. When finishing the image forming processing (S1013: Y), the CPU 301 finishes the processing as it is.

As mentioned, when forming the image on the sheet S, or when forming the image other than the color registration detection toner image on the intermediate transfer belt 711, if the image formed immediately before is not the color registration detection toner image, it is not necessary to wait until the rotation of the polygon mirror 805 is stabilized. It means that the writing start timing in the sub-scanning direction of the image other than the color registration correction image which is not transferred to the sheet S corresponds to the writing start timing in the sub-scanning direction at which the skew of the sheet S is corrected. Also, in each timing, the rotation phases of the polygon mirror 805 are identical to each other. Thus, for example, when switching from the processing to form the density detection toner image to the processing to the normal image forming processing for forming the image on the sheet S, the standby time required until the rotation of the polygon mirror 805 is stabilized becomes unnecessary, which enhances productivity.

(When the Amount of Skew Differs for Every Sheet S)

Due to the weight or the surface condition of the sheet, the amount of skew of the sheet S may differ sheet by sheet. When the amount of skew differs sheet by sheet, the rotation phase of the polygon mirror 805 needs to be controlled sheet by sheet. For example, when the image formation is alternatively performed to the sheet having the different weight sheet by sheet, it becomes necessary to control the rotation phase of the polygon mirror 805 sheet by sheet. This causes the reduction of productivity because the standby time required until the rotation of the polygon mirror 805 is stabilized occurs. Thus, when the skew correction is performed sheet by sheet, instead of changing the writing start timing in the sub-scanning direction by changing the rotation phase of the polygon mirror 805, the writing time in the sub-scanning direction by a unit of one pixel is changed. Due to this, reduction of productivity caused by controlling the rotation phase of the polygon mirror 805 can be prevented.

In the present embodiment, the image detection sensor 740 detects the color registration detection toner image and the density detection toner image formed on the intermediate transfer belt 711. However, the image detection sensor 740, which is an optical sensor, is incapable of detecting the black toner image formed on the intermediate transfer belt 711. Then, detection of the black toner image may be performed on the photoreceptor 708K. In this case, the optical sensor is provided at a position where the toner image on the photoreceptor 708 is detectable. For example, unlike the color registration detection toner image, the black density detection toner image need not consider the image forming position with respect to the toner images of other colors. Thus, the detection of the black density detection toner image may be performed on the photoreceptor 708K. When performing the density correction, the CPU 301 causes the image forming unit which forms the images of yellow, magenta, and cyan to form the density detection toner image on the intermediate transfer belt 711. The CPU 301 does not cause the image forming unit which forms the image of black to form the density detection toner image on the intermediate transfer belt 711. As mentioned, in the image forming apparatus 701 of the present embodiment, the standby time required until the rotation of the polygon mirror 805, which is the rotating polygon mirror, is stabilized is suppressed, which enhances the productivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-105571, filed May 21, 2014 which is hereby incorporated by reference wherein in its entirety.

What is claimed is:

1. An image forming apparatus comprising:

a first image forming unit having a first photoreceptor and a first laser scanner including a first light source which emits a first laser light and a first rotating polygon mirror which reflects the first laser light such that the first laser light scans the first photoreceptor and, the first image forming unit is configured to form a first toner image, using a first toner, by developing an electrostatic latent image formed on the first photoreceptor by scanning the first laser light;

a second image forming unit having a second photoreceptor and a second laser scanner including a second light source which emits a second laser light and a second rotating polygon mirror which reflects the second laser light such that the second laser light scans the second photoreceptor, the second image forming unit is configured to form a second toner image, using a second toner having a color which is different from a color of the first toner, by developing an electrostatic latent image formed on the second photoreceptor by scanning the second laser light;

an intermediate transfer member to which the first toner image formed on the first photoreceptor and the second toner image formed on the second photoreceptor are transferred;

a transfer unit configured to transfer the first toner image and the second toner image transferred to the intermediate transfer member to a recording medium;

a conveyance unit configured to convey the recording medium to a transfer position at which toner images on the intermediate transfer member are transferred to the recording medium by the transfer unit;

a first optical sensor configured to detect the first toner image and the second toner image transferred to the intermediate transfer member;

a second optical sensor arranged at a position different from where the first optical sensor is arranged in a direction which crosses a direction in which the surface of the intermediate transfer member moves and configured to detect the first toner image and the second toner image formed on the intermediate transfer member;

a storing unit configured to store data relating to the amount of skew of the recording medium to be conveyed to the transfer position by the conveyance unit in a conveying direction of the recording medium at the transfer position; and a control unit configured to control the first image forming unit and the second image forming unit, wherein the control unit is further configured to:

control, based on at least one of the data relating to the amount of skew and a detection result of a color registration detection toner image for detecting relative position relation of the first toner image and the second toner image, toner image forming positions of the first toner image and the second toner image by controlling at least one of a phase relation of the first rotating polygon mirror and the second rotating polygon mirror and an emission timing of the first laser light and an emission timing of the second laser light;

cause the first image forming unit and the second image forming unit to form the color registration detection toner image without correcting the first toner image forming position and the second toner image forming position using the data relating to the amount of skew;

control, based on the data relating to the amount of skew and the detection result of the color registration detection toner image detected by the first optical sensor and the second optical sensor, the emission timing of the first laser light and the emission timing of the second laser light to correct the rotation phase relation of the first rotating polygon mirror and the second rotating polygon mirror, and to correct the image forming position of the recording medium in the conveying direction of the recording medium such that the first toner image and the second toner image to be transferred to the recording medium is formed on the intermediate transfer member corresponding to the amount of skew of the recording medium to be conveyed to the transfer position and color registration between the first toner image and the second toner image is suppressed, and cause the first image forming unit and the second image forming unit to form density detection toner image for detecting density of the first toner image and the second toner image formed by the first image forming unit and the second image forming unit by controlling the emission timing of the first laser light and the emission timing of the second laser light without controlling the rotation phase relation based on the data relating to the amount of skew and the detection result of the color registration detection toner image detected by the first optical sensor and the second optical sensor.

2. The image forming apparatus according to claim 1, wherein:

the control unit is further configured to control the first image forming unit and the second image forming unit such that the color registration detection toner image and the density detection toner image are detected by the first optical sensor and the second optical sensor.

3. The image forming apparatus according to claim 1, wherein the control unit is further configured to:

cause the first toner image and the second toner image to be transferred to the recording medium to correspond to the amount of skew of the recording medium to be conveyed to the transfer position; and correct the first toner image forming position and the second toner image forming position in the conveying direction of the recording medium by a unit of less than an interval between scanning lines by controlling the rotation phase relation of the first rotating polygon mirror and the second rotating polygon mirror and by controlling the emission timing of the first laser light and the emission timing of the second laser light for correcting the image forming position of the recording medium based on the data relating to the amount of skew and the detection result of the color registration detection toner image detected by the first optical sensor and the second optical sensor.

4. The image forming apparatus according to claim 1, wherein:

the control unit is further configured to correct the first toner image forming position and the second toner image forming position in the conveying direction of the recording medium by a unit of an interval between scanning lines by controlling the emission timing of the first laser light and the emission timing of the second laser light without controlling the rotation phase relation based on the data relating to the amount of skew and the detection result of the color registration detection toner image detected by the first optical sensor and the second optical sensor.

5. The image forming apparatus according to claim 1, wherein:

the control unit is further configured to form the image to be transferred to the recording medium and the density detection toner image after controlling the emission timing of the first laser light and the emission timing of the second laser light and the rotation phase relation of the first rotating polygon mirror and the second rotating polygon mirror if the color registration detection toner image is already formed before the image to be transferred to the recording medium and the density detection toner image are formed.

6. The image forming apparatus according to claim 1, wherein the control unit is further configured to shift, when alternatively forming the image on one or more recording medium having different amount of skew, the image forming position which is alternatively formed on the one or more recording medium by a unit of pixel by controlling the emission timing of the laser light of each laser scanner.

7. The image forming apparatus according to claim 1, wherein the control unit is further configured to form the image to be transferred to the recording medium by performing y correction such that the density of the toner image formed on each photoreceptor corresponds to target density according to detection result of the density detection toner image detected by the second detection unit.

8. The image forming apparatus according to claim 1, further comprising:

an operation unit configured to input the data relating to the amount of skew, wherein:

the control unit is further configured to cause the first image forming unit and the second image forming unit to form test pattern without using the data relating to the amount of skew, and wherein the storing unit is configured to store the data relating to the amount of skew input by the operation unit based on the test pattern formed on the recording medium.

9. The image forming apparatus according to claim 1, wherein the emission timing control is to control the emission of the laser light for forming the toner image to be transferred to one recording medium to delay or advance by a unit of laser light scanning period.

10. The image forming apparatus according to claim 1, wherein the first image forming unit is configured to form any one of the toner images of yellow, magenta or cyan, and the second image forming unit is configured to form the toner image of yellow, magenta or cyan, the color of which is different from the toner image formed in the first image forming unit.

11. The image forming apparatus according to claim 1, wherein the control unit is further configured to correct image data such that the first toner image and the second toner image to be transferred to the recording medium is formed on the intermediate transfer member corresponding to the amount of skew of the recording medium to be conveyed to the transfer position.

12. The image forming apparatus according to claim 1, wherein the direction which crosses a direction in which the surface of the intermediate transfer member moves is a direction which is almost orthogonal to the direction which the surface of the intermediate transfer member moves.

13. An image forming method executed by an image forming apparatus which comprises:

a first image forming unit having a first photoreceptor and a first laser scanner including a first light source which emits a first laser light and a first rotating polygon mirror which reflects the first laser light such that the first laser light scans the first photoreceptor and, the first image forming unit is configured to form a first toner image, using a first toner, by developing an electrostatic latent image formed on the first photoreceptor by scanning the first laser light;

a second image forming unit having a second photoreceptor and a second laser scanner including a second light source which emits a second laser light and a second rotating polygon mirror which reflects the second laser light such that the second laser light scans the second photoreceptor, the second image forming unit is configured to form a second toner image, using a second toner having a color which is different from a color of the first toner, by developing an electrostatic latent image formed on the second photoreceptor by scanning the second laser light;

an intermediate transfer member to which the first toner image formed on the first photoreceptor and the second toner image formed on the second photoreceptor are transferred;

a transfer unit configured to transfer the first toner image and the second toner image transferred to the intermediate transfer member to a recording medium;

a conveyance unit configured to convey the recording medium to a transfer position at which toner images on the intermediate transfer member are transferred to the recording medium by the transfer unit;

a first optical sensor configured to detect the first toner image and the second toner image transferred to the intermediate transfer member;

a second optical sensor arranged at a position different from where the first optical sensor is arranged in a direction which crosses a direction in which the surface of the intermediate transfer member moves and configured to detect the first toner image and the second toner image formed on the intermediate transfer member;

a storing unit configured to store data relating to the amount of skew of the recording medium to be conveyed to the transfer position by the conveyance unit in a conveying direction of the recording medium at the transfer position; and a control unit configured to control the first image forming unit and the second image forming unit, wherein the control unit is further configured to:

cause the first image forming unit and the second image forming unit to form the color registration detection toner image for detecting relative position relation of the first toner image and the second toner image without correcting the image forming position using the data relating to the amount of skew;

control, based on the data relating to the amount of skew and the detection result of the color registration detection toner image detected by the first optical sensor and the second optical sensor, the emission timing of the first laser light and the emission timing of the second laser light to correct the rotation phase relation of the first rotating polygon mirror and the second rotating polygon mirror, and to correct the image forming position of the recording medium in the conveying direction of the recording medium such that the first toner image and the second toner image to be transferred to the recording medium is formed on the intermediate transfer member corresponding to the amount of skew of the recording medium to be conveyed to the transfer position and color registration between the first toner image and the second toner image is suppressed; and cause the first image forming unit and the second image forming unit to form density detection toner image for detecting density of the first toner image and the second toner image formed by the first image forming unit and the second image forming unit by controlling the emission timing of the first laser light and the emission timing of the second laser light without controlling the rotation phase relation based on the data relating to the amount of skew and the detection result of the color registration detection toner image detected by the first optical sensor and the second optical sensor.

14. An image forming apparatus comprising:

a first image forming unit having a first photoreceptor and a first laser scanner including a first light source which emits a first laser light and a first rotating polygon mirror which reflects the first laser light such that the first laser light scans the first photoreceptor and, the first image forming unit is configured to form a first toner image by developing, using a first toner, an electrostatic latent image formed on the first photoreceptor by scanning the first laser light;

a second image forming unit having a second photoreceptor and a second laser scanner including a second light source which emits a second laser light and a second rotating polygon mirror which reflects the second laser light such that the second laser light scans the second photoreceptor, the second image forming unit is configured to form a second toner image by developing, using a second toner having a color which is different from a color of the first toner, an electrostatic latent image formed on the second photoreceptor by scanning the second laser light;

a transfer unit including an intermediate transfer member, configured to transfer the first toner image on the first photoreceptor and the second toner image on the second photoreceptor to the intermediate transfer member, and configured to transfer toner images on the intermediate transfer member to a recording medium;

a conveyance unit configured to convey the recording medium to a transfer position at which toner images on the intermediate transfer member are transferred to the recording medium;

a first optical sensor configured to detect the toner image on the intermediate transfer member;

a second optical sensor arranged at a position different from where the first optical sensor is arranged in a direction which crosses a direction in which the surface of the intermediate transfer member moves and configured to detect the toner image on the intermediate transfer member;

a storing unit configured to store a correction data for:

aligning, with respect to a skew of the recording medium in a conveying direction of the recording medium at the transfer position, 1) a skew of the first toner image to be transferred to the recording medium and 2) a skew of the second toner image to be transferred to the recording medium, and suppressing a registration between the first image and the second image on the recording medium;

a control unit configured to be able to control a rotating phase relationship between the first rotating polygon mirror and the second rotating polygon mirror to correct a registration less than a unit of one scanning line between the first toner image and the second toner image in the conveying direction of the recording medium, and configured to be able to control image data and output start timing of the image data based on the correction data;

wherein the control unit is configured, for forming a toner image to be transferred on the recording medium and based on the correction data, to:

control the rotating phase relationship;

correct the image data; and control an output start timings for 1) outputting the corrected image data to the first image forming unit and 2) outputting the corrected image data to the second image forming unit, wherein, when causing the first image forming unit and the second image forming unit to form, between a toner image to be transferred on a preceding recording medium and a toner image to be transferred on a following recording medium, a toner image for density detection to be detected by the first optical sensor and the second optical sensor, the control unit is configured to 1) maintain the rotating phase relationship at the time of forming the toner image for density detection and 2) not perform controlling of the output start timings.

15. The image forming apparatus according to claim 14, wherein the control unit controls the densities of toner images which the first image forming unit and the second image forming unit form after forming the toner image for density detection.

16. The image forming apparatus according to claim 14, further comprising:

wherein the control unit is configured to cause the first image forming unit and the second image forming unit to form a toner image for detecting a color registration;

wherein the toner image for detecting a color registration is detected by the first optical sensor and the second optical sensor;

wherein the correction data to be stored in the storing unit comprises an amount of skew correction for correcting a skew of the recording medium to the transfer position and an amount of color registration correction based on the detected result of the toner image for detecting a color registration detected by the first optical sensor and the second optical sensor, and an amount of an inclination correction of the toner image.

* * * * *